US006350567B1

(12) United States Patent
Chen et al.

(10) Patent No.: US 6,350,567 B1
(45) Date of Patent: Feb. 26, 2002

(54) PRECIPITATION OF HIGH CHLORIDE CONTENT SILVER HALIDE EMULSIONS

(75) Inventors: Benjamin T. Chen, Penfield; Roger L. Klaus; Jeri L. Mount, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/414,198

(22) Filed: Oct. 7, 1999

Related U.S. Application Data

(63) Continuation-in-part of application No. 09/177,640, filed on Oct. 22, 1998.

(51) Int. Cl.[7] ..... G03C 1/34

(52) U.S. Cl. ..... 430/599; 430/567; 430/569; 430/600; 430/603; 430/605; 430/607; 430/613; 430/614

(58) Field of Search ..... 430/569, 613, 430/614, 599, 603, 605, 607, 567, 600

(56) References Cited

U.S. PATENT DOCUMENTS

| | | | | |
|---|---|---|---|---|
| 2,870,015 A | | 1/1959 | Allen et al. | 430/614 |
| 4,224,403 A | | 9/1980 | Toda et al. | 430/537 |
| 4,490,462 A | | 12/1984 | Kawaguchi et al. | 430/543 |
| 5,059,516 A | | 10/1991 | Sato et al. | 430/614 |
| 5,264,337 A | | 11/1993 | Maskasky | 430/567 |
| 5,468,602 A | | 11/1995 | Takahashi | 430/614 |
| 5,547,827 A | | 8/1996 | Chen et al. | 430/567 |
| 5,550,013 A | | 8/1996 | Chen et al. | 430/567 |
| 5,605,789 A | | 2/1997 | Chen et al. | 430/567 |
| 5,674,674 A | | 10/1997 | Edwards et al. | 430/567 |
| 5,726,005 A | | 3/1998 | Chen et al. | 430/567 |
| 5,728,516 A | | 3/1998 | Edwards et al. | 430/567 |
| 5,736,310 A | | 4/1998 | Chen et al. | 430/567 |
| 5,968,724 A | * | 10/1999 | Eikenberry et al. | 430/614 |
| 6,214,529 B1 | * | 4/2001 | Eikenberry et al. | 430/449 |

FOREIGN PATENT DOCUMENTS

| | | | |
|---|---|---|---|
| JP | 10-83039 | * | 3/1998 |
| JP | 10-90822 | * | 4/1998 |

OTHER PUBLICATIONS

Japanese Abstract 09–329862.
Japanese Abstract 10–011739.
Japanese Abstract 09–133977.
Research Disclosure No. 37026, Feb. 1995.

* cited by examiner

*Primary Examiner*—Janet Baxter
*Assistant Examiner*—Amanda C. Walke
(74) *Attorney, Agent, or Firm*—Sarah Meeks Roberts

(57) ABSTRACT

A silver halide photographic element comprising a silver halide emulsion which is greater than 50 mole-% silver chloride, said emulsion containing an isothiazolone compound represented by the formula

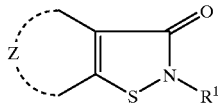

wherein $R^1$ is a substituent; and Z contains the carbon atoms necessary to form a substituted or unsubstituted non-aromatic ring, wherein the isothiazolone compound was added before or during precipitation of the emulsion.

19 Claims, No Drawings

PRECIPITATION OF HIGH CHLORIDE CONTENT SILVER HALIDE EMULSIONS

CROSS REFERENCE TO RELATED APPLICATIONS

This is a continuation-in-part application of Ser. No. 09/177,640 filed Oct. 22, 1998 entitled "Precipitation of High Chloride Content Silver Halide Emulsions" by Chen et al.

FIELD OF THE INVENTION

This invention relates to silver halide emulsions containing isothiazolone compounds and methods of making such emulsions.

BACKGROUND OF THE INVENTION

Problems with fogging have plagued the photographic industry from its inception. Fog is a deposit of silver or dye that is not directly related to the image-forming exposure, e.g., when a developer acts upon an emulsion layer, some reduced silver is formed in areas that have not been exposed to light. The fog sites on silver halide crystals can originate during emulsion manufacture or during aging of the photographic element. During the aging process, fog can become exaggerated by extremes in temperature and humidity. Fog can be defined as developed density that is not associated with the action of the image-forming exposure, and is usually expressed as "D-min", the density obtained in the unexposed portions of the emulsion. Developed density, as normally measured, includes both that produced by fog and that produced by exposure to light.

Silver halide emulsions containing a high content of chloride, such as silver chloride or silver iodochloride, are known for their high photographic sensitivities and rapid processability as described in, for example, U.S. Pat. Nos. 5,736,310; 5,728,516; 5,726,005; and 5,674,674. Such emulsions are also prone to large degrees of fogging, especially in context with their use in reflective-support photographic display materials. To minimize this fog, mercuric salts and other antifoggants have been employed to satisfaction as described in, for example, U.S. Pat. Nos. 5,605,789; 5,550,013; and 5,547,827. Unfortunately, such fog-combating compounds are not without drawbacks. In recent years, it has become necessary to eliminate the need for mercuric salts in photographic products, especially in high chloride content emulsion formulations. Many other compounds which are useful as antifoggants also reduce speed. Even when using mercuric salts or other antifoggants during emulsion precipitation, where fog density is generally less than 0.10 reflection density, other means are needed to prevent the coated emulsion from undergoing changes during the aging processes.

In this invention it has been discovered that a specific group of isothiazolones is particularly useful in controlling fog in high chloride emulsions when added before or during precipitation of certain emulsions. Isothiazolones are known as useful biocides for silver halide photographic elements as described in Research Disclosure 37026, February 1995; in U.S. Pat. Nos. 4,224,403 and 4,490,462; and in JP 09-329862 and JP 10-011739. JP 09-133977 describes one class of isothiazolones as reducing fog when added during precipitation of a silver halide emulsion. However, nowhere has it been recognized or described that the specific group of isothiazolones of the invention confers significant advantageous sensitometric benefits when present during emulsion precipitation.

SUMMARY OF THE INVENTION

This invention provides a silver halide photographic element comprising a silver halide emulsion which is greater than 50 mole-% silver chloride, said emulsion containing an isothiazolone compound represented by the formula

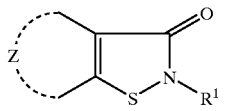

wherein $R^1$ is a substituent; and Z contains the carbon atoms necessary to form a substituted or unsubstituted non-aromatic ring, wherein the isothiazolone compound was added before or during precipitation of the emulsion. It also provides a method of making the above described emulsion.

The isothiazolones used in this invention are highly effective at suppressing fog in silver halide emulsions when used during the precipitation stage of the emulsion manufacture. Not only do the isothiazolones reduce fog, they also stabilize the emulsion against sensitometric changes during aging of the emulsion. Further, they do so without significantly reducing speed.

DETAILED DESCRIPTION OF THE INVENTION

The isothiazolone compounds utilized in this invention are represented by the formula

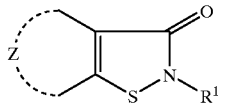

Z contains the carbon atoms necessary to form a substituted or unsubstituted non-aromatic ring. Preferably Z is a substituted or unsubstituted five or six-membered non-aromatic ring, and more preferably Z is a substituted or unsubstituted five-membered non-aromatic ring. In one suitable embodiment Z is an unsubstituted non-aromatic five-membered ring.

$R^1$ can be any substituent which is suitable for use in a silver halide photographic element and which does not interfere with the fog restraining activity of the isothiazolone compound. Preferably $R^1$ is a substituted or unsubstituted aliphatic, aromatic or heterocyclic group.

When $R^1$ is an aliphatic group, preferably, it is an alkyl group having from 1 to 20 carbon atoms, or an alkenyl or alkynyl group having from 2 to 20 carbon atoms. More preferably, it is an alkyl group having 1 to 6 carbon atoms, or an alkenyl or alkynyl group having 3 to 5 carbon atoms. Most preferably it is an alkyl group having 1 to 3 carbon atoms. These groups may or may not have substituents. Examples of alkyl groups include methyl, ethyl, propyl, butyl, pentyl, hexyl, octyl, 2-ethylhexyl, decyl, dodecyl, hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings or condensed rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Nonlimiting examples of substituent groups for $R^1$ and Z include alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), ether groups (for example methoxy, ethoxy, propoxy, butoxy), hydroxyl groups and nitrile groups. Preferred substituents are lower alkyl groups, i.e., those having 1 to 4 carbon atoms (for example, methyl), hydroxyl groups, and halogen groups (for example, chloro).

The isothiazolones may be prepared as described in U.S. Pat. Nos. 4,708,959—Shroot et al; 4,851,541—Maignan et al; 5,082,966—Moffat; 5,336,777—Moffat et al; and 5,466,814—Moffat et al, all of which are incorporated herein by reference. Some of them are also available commercially from Zeneca Biocides, Inc., Wilmington, Del.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), alkoxy groups, hydroxy groups, alkylthio groups, arylthio groups, acylamino groups, sulfonylamino groups, acyloxy groups, carboxyl groups, cyano groups, sulfo groups and amino groups.

Useful levels of the isothiazolone compounds range from about 0.02 to 10 mmole/mole Ag, more preferably 0.05 to 2.0 mmole/mole Ag, and most preferably 0.10 to 1.0 mmole/mole Ag. The isothiazolone compounds may be used in addition to any conventional emulsion stabilizer or antifoggant as commonly practiced in the art. Combinations of more than one isothiazolone compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C. and maintained for a period of time. The emulsion is then cooled to about 40° C. or less to stop chemical sensitization. The precipitation and spectral and chemical sensitization methods utilized in preparing the emulsions employed in the invention can be any of those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The isothiazolone compounds may be added to the photographic emulsion anytime before or during precipitation, however they must be added before the end of precipitation. The compounds may be added using any technique suitable for this purpose. For example, they may be added to the vessel containing the aqueous gelatin and salt solution before the start of the precipitation; they may also be added during precipitation to the salt solution, the silver nitrate solution, or from a separate jet directly into the kettle. A preferred method of addition is to add the isothiazolone compounds to the reaction kettle after the initial nucleation stage. Equally preferred is to add the compounds during the crystal growth phase of precipitation. The compounds can be added from solutions or as solids. For example, they can be dissolved in a suitable solvent and added directly to the precipitation solutions.

The silver halide emulsions utilized in this invention are greater than 50 mole-% silver chloride. More preferably the emulsions are greater than 90 mole-% silver chloride and most preferably greater than 95 mole-% silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

The photographic elements suitable for use with this invention may be simple single layer elements or multilayer, multicolor elements. They may also be black and white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements, or transmission or reflection elements (including color paper).

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |

-continued

| Reference | Section | Subject Matter |
|---|---|---|
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wavelike radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment.

The following examples illustrate the practice of this invention. They are not intended to be exhaustive of all possible variations of the invention.

EXAMPLES

Compound A

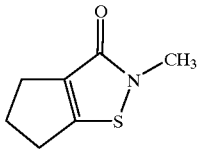

Example 1

Preparation of Emulsion E-1. A stirred tank reactor containing 6.65 kg of pure water, 201 g ossein gelatin and 2.0 M NaCl was adjusted to pAg 7.15 at 68.3° C. 1,8-dihydroxy-3,6-dithiaoctane in the amount of 1.65 g was added to the reactor 30 seconds before the double jet addition of 3.722 M silver nitrate, containing 0.29 micromoles of mercuric chloride per mole silver, at 39.9 mL per minute; and 3.8 M sodium chloride at a rate controlled to maintain a constant pAg of 7.15. The silver nitrate addition rate remained at 39.9 mL per minute for 5.25 minutes, then it was accelerated to 80.3 mL per minute over a period of 7.5 minutes while the salt stream was adjusted to hold at pAg 7.15. The silver nitrate addition rate remained at 80.3 mL per minute for another 22.9 minutes while the pAg was maintained at 7.15, resulting in precipitation of 93% of the total silver to be introduced. At this point, 200 mL of a solution that contained 4.98 g potassium iodide was dumped into the reactor. The silver nitrate and sodium chloride salt solution additions following the potassium iodide dump were continued as before the dump for another 2.33 minutes to provide a total of 10 moles of silver iodochloride emulsion that contained 0.3 mole-% iodide. The emulsion exhibited monodispersed tetradecahedral grains with a mean grain size of 0.76 micrometers in cubic edge length.

Preparation of Emulsion E-2. This emulsion was precipitated similarly to Emulsion E-1, except that the mercuric chloride was omitted from the silver nitrate solution. A total of 10 moles of silver iodochloride emulsion was precipitated in the form of monodispersed tetradecahedral grains having a mean grain size of 0.76 micrometers in cubic edge length.

Preparation of Emulsion E-3. This emulsion was precipitated similarly to Emulsion E-2, except that Compound A was added to the reactor kettle at a concentration of 700 mg per mole of silver after a 5.25 minute nucleation period at the beginning of the precipitation. A total of 10 moles of silver iodochloride emulsion was precipitated in the form of monodispersed tetradecahedral grains having a mean grain size of 0.75 micrometers in cubic edge length.

Preparation of Emulsion E-4. This emulsion was precipitated similarly to Emulsion E-3, except that Compound A was added to the reactor kettle at a concentration of 1400 mg per mole of silver after a 5.25 minute nucleation period at the beginning of the precipitation. A total of 10 moles of silver iodochloride emulsion was precipitated in the form of monodispersed tetradecahedral grains having a mean grain size of 0.75 micrometers in cubic edge length.

Emulsions E-1, E-2, E-3, and E-4 were treated separately with colloidal gold sulfide at a concentration of 4.6 mg per mole silver halide for 6 minutes at 40° C. Then at 60° C. the triethylammonium salt of spectral sensitizing dye SS-1 in the amount of 220 mg per mole of silver halide and 1-(3-acetamidophenyl) -5-mercaptotetrazole in the amount of 103 mg per mole of silver halide were added to the emulsions and then held at temperature for 27 minutes.

The sensitized emulsions were coated separately on resin coated paper support. The coatings contained (all per square meter) 260 mg silver, 1000 mg yellow dye forming coupler Coupler YD-1, 270 mg of di-n-butylphthalate, and 1700 mg gelatin. Conventional coating aids were used in the coating process and the entire coated film was hardened with bis-(vinylsulfonyl-methyl)ether.

The coatings were evaluated both within 2 days of drying and after aging under controlled conditions of 49° C. temperature and 50% relative humidity for 7 days, and −18° C. temperature and 50% relative humidity for 7 days.

The coatings were exposed for 0.1 second through a 0 to 3.0 density (D) step tablet (delta D=0.15) to light in a Kodak Model 1B sensitometer with a color temperature of 3000 K which was filtered with a combination of Kodak Wratten 2C and a Kodak Color Compensating filter of 130 cc yellow and a 0.3 neutral density filter. The exposed coatings were processed using the Kodak RA4 process described in "Using Kodak EKTACOLOR RA Chemicals", Publication No. Z-130, published by the Eastman Kodak Co., 1990. The sensitometric results of filtered white light exposure are summarized in Table 1. In Table 1 the sensitometric stabilization after aging is represented by the difference between the two temperature conditions. For differences in D-min, smaller numbers are desired. For differences in speed and contrast, numbers close to zero are desired.

Coupler YD-1

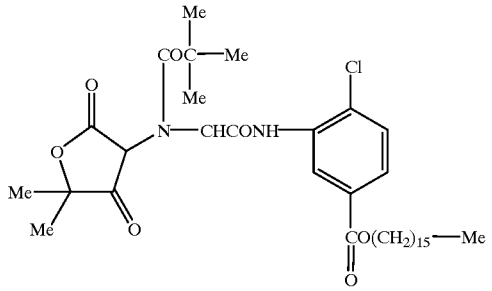

Sensitizing Dye SS-1

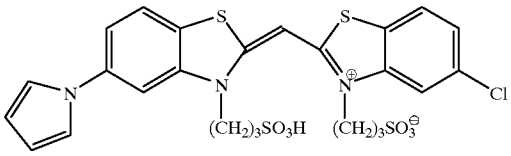

Sensitizing Dye SS-2

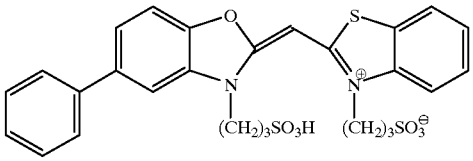

TABLE 1

| | | Change after 7 days | | |
|---|---|---|---|---|
| Emulsion | D-min | Speed | D-min | Contrast |
| E-1 (comparison) | 0.123 | 11 | 0.053 | −0.424 |
| E-2 (comparison) | 0.121 | 13 | 0.051 | −0.399 |
| E-3 (invention) | 0.098 | 11 | 0.027 | −0.303 |
| E-4 (invention) | 0.084 | 6 | 0.018 | −0.322 |

It is clear from Table 1 that Compound A greatly reduced the fresh D-min of the emulsion when used in the precipitation, and additionally conferred a marked increase in the sensitometric stability of the emulsion coatings after aging. This effect is not resulting from the action of Compound A during chemical sensitization since high performance liquid chromatographic analyses of emulsion precipitated in the presence of Compound A showed no detectable level after conventional emulsion washing procedure.

Example 2

Preparation of Emulsion E-5. Seven solutions were prepared as follows:

| | |
|---|---|
| Solution A1 | |
| Gelatin | 183.6 g |
| NaBr | 3.06 g |
| WATER | 8160 g |
| Solution B1 | |
| NaBr | 1.26 g |
| WATER | 30.25 g |

-continued

| | |
|---|---|
| Solution C1 | |
| $AgNO_3$ (5.722M) | 2062.75 g |
| WATER | 506.55 g |
| Solution D1 | |
| NaCl | 456.54 g |
| WATER | 1789.61 g |
| Solution E1 | |
| KI | 5.17 g |
| WATER | 73.44 g |
| Solution F1 | |
| Phthalated Gelatin | 180 g |
| WATER | 1000 g |
| Solution G1 | |
| Ossein Gelatin | 154 g |
| WATER | 1000 g |

Solution A1 was charged into a reaction vessel equipped with a stirrer. The temperature was adjusted to 30° C. While vigorously stirring the reaction vessel, Solutions B1 and C1 were added at a rate of 30.6 mL/min for 1.50 minutes. The emulsion was held for 3 minutes. Following this hold, Solutions C1 and D1 were added at a rate of 30.6 and 33.5 mL/min, respectively, for 5 minutes, maintaining the vAg at 140 mV. For the next 18 minutes the temperature was increased from 30° C. to 60° C. The mixture was held for 10 minutes. Following this hold, Solutions C1 and D1 were added simultaneously at a linearly accelerated rate from 30.6 mL/min to 39.8mL/min in 10 minutes with the vAg maintained at 140 mV. The mixture was held for 10 minutes. Following this hold, Solutions C1 and D1 were again added simultaneously at a linearly accelerated rate from 64.3 mL/min to 73.4 ml/min in 10 minutes. The mixture was held for 30 minutes. Following this hold, Solution C1 was added at a rate of 14 mL/min until a vAg of 160 mV was attained. The mixture was held for 10 minutes. Following this hold, Solution E1 was delivered at once by manually dumping it into the reaction vessel in less than 5 seconds. The mixture was held for 20 minutes. Following this hold, Solutions C1 and D1 were added at a rate of 9.5 mL/min in 17.5 minutes maintaining the vAg at 160 mV. Solution D1 was then added at a rate of 35 mL/min until a vAg of 130 mV was attained. The mixture was then cooled to 40° C. Solution F1 was added and stirred for 5 minutes. The pH was adjusted to 3.8 and the gel coagulum allowed to settle. The liquid layer was decanted and the depleted volume was restored with purified water. The mixture was held until the temperature returned to 40° C. The pH was then adjusted to 4.2 and the mixture stirred for 5 minutes before the pH was adjusted to 3.8 and the settling and decanting steps repeated. Solution G1 was added and the pH and vAg were adjusted to 5.7 and 130 mV, respectively. The resulting silver iodochloride emulsion contained 0.5 mole-% iodide and had a <100> tabular morphology with an equivalent circular diameter of 0.84 micrometers and a thickness of 0.16 micrometers.

Preparation of Emulsion E-6. Emulsion E-6 was prepared identically to Emulsion E-5 except that 2.43 mg of p-glutaramidophenyl disulfide was added to Solution A1. The resulting silver iodochloride emulsion contained 0.5 mole-% iodide and had a <100> tabular morphology with an equivalent circular diameter of 1.00 micrometers and a thickness of 0.16 micrometers.

Preparation of Emulsion E-7. Eight solutions were prepared as follows:

| | |
|---|---|
| Solution A3 | |
| Gelatin | 183.6 g |
| NaBr | 3.06 g |
| WATER | 8160 g |
| Solution B3 | |
| NaBr | 1.26 g |
| WATER | 30.25 g |
| Solution C3 | |
| $AgNO_3$ (5.722M) | 2062.75 g |
| WATER | 506.55 g |
| Solution D3 | |
| NaCl | 456.54 g |
| WATER | 1789.61 g |
| Solution E3 | |
| Compound A | 1.208 g |
| WATER | 98.61 g |
| Solution F3 | |
| KI | 5.17 g |
| WATER | 73.44 g |
| Solution G3 | |
| Phthalated Gelatin | 180 g |
| WATER | 1000 g |
| Solution H3 | |
| Ossein Gelatin | 154 g |
| WATER | 1000 g |

Solution A3 was charged into a reaction vessel equipped with a stirrer. The temperature was adjusted to 30° C. While vigorously stirring the reaction vessel, Solutions B3 and C3 were added at a rate of 30.6 mL/min for 1.50 minutes. The emulsion was held for 3 minutes. Following this hold, Solutions C3 and D3 were added at a rate of 30.6 and 33.5 mL/min, respectively, for 5 minutes, maintaining the vAg at 140 mV. For the next 18 minutes the temperature was increased from 30° C. to 60° C. The mixture was held for 10 minutes. Following this hold, Solutions C3 and D3 were added simultaneously at a linearly accelerated rate from 30.6 mL/min to 39.8 mL/min and Solution E3 was added at a constant rate of 10 mL/min in 10 minutes with the vAg maintained at 140 mV. The mixture was held for 10 minutes. Following this hold, Solutions C3 and D3 were again added simultaneously at a linearly accelerated rate from 64.3 mL/min to 73.4 mL/min in 10 minutes. The mixture was held for 30 minutes. Following this hold, Solution C3 was added at a rate of 14 mL/min until a vAg of 160 mV was attained. The mixture was held for 10 minutes. Following this hold, Solution F3 was delivered at once by manually dumping it into the reaction vessel in less than 5 seconds. The mixture was held for 20 minutes. Following this hold, Solutions C3 and D3 were added at a rate of 9.5 mL/min in 17.5 minutes maintaining the vAg at 160 mV. Solution D3 was then added at a rate of 35 ml/min until a vAg of 130 mV was attained. The mixture was then cooled to 40° C. Solution G3 was added and stirred for 5 minutes. The pH was adjusted to 3.8 and the gel coagulum allowed to settle.

The liquid layer was decanted and the depleted volume was restored with purified water. The mixture was held until the temperature returned to 40° C. The pH was then adjusted to 4.2 and the mixture stirred for 5 minutes before the pH was adjusted to 3.8 and the settling and decanting steps repeated. Solution H3 was added and the pH and vAg were adjusted to 5.7 and 130 mV, respectively. The resulting silver iodochloride emulsion contained 0.5 mole-% iodide and had a <100> tabular morphology with and equivalent circular diameter of 0.96 micrometers and a thickness of 0.16 micrometers.

Prior to sensitization, 50 mg/Ag mole of KBr was added to each emulsion at 40° C. 1-(3-acetamidophenyl)-5-mercaptotetrazole was added to Emulsions E-5 and E-6. All emulsions were treated with potassium tetrachloroaurate and the triethylammonium salts of sensitizing dyes SS-1 and SS-2 followed by a 20 minute hold. Then each emulsion received sodium thiosulfate pentahydrate followed by a 5 minute hold. The emulsions were then heated for 25 minutes at 60° C. Following heating, 1-(3-acetamidophenyl)-5-mercaptotetrazole, 1-phenyl-5-mercaptotetrazole, and KBr were added to each emulsion at 40° C. with a 5 minute hold between additions.

Following the treatment described above, the emulsions were each coated onto a transparent film support at 646 mg Ag/$m^2$ with the added yellow dye-forming coupler YD-1 coated at 1345 mg/$m^2$. A protective gelatin layer containing hardener was coated over each emulsion layer.

The resulting elements were each given a stepped exposure for 0.004 second using a 3000 K light source passed through a heat filter, 0.45 neutral density filter, and a 1700 filter. The elements were processed for 3 minutes using ECP-2B as described in Kodak H-24 Manual, published by Eastman Kodak Co., and their D-min and speed values are shown in Table 2.

TABLE 2

| Emulsion | D-min | Speed @ density = 1 |
|---|---|---|
| E-5 (comparison) | 0.51 | 334 |
| E-6 (comparison) | 0.26 | 286 |
| E-7 (invention) | 0.23 | 291 |

It can be seen in Table 2 that use of Compound A in the precipitation of a tabular silver iodochloride emulsion greatly reduced the D-min relative to the emulsion made in the absence of antifoggant. Additionally, the use of Compound A gave superior D-min and speed properties relative to the comparative disulfide compound of U.S. Pat. No. 5,418,127.

The invention has been described in detail with particular reference to certain preferred embodiments thereof, but it will be understood that variations and modifications can be effected within the spirit and scope of the invention.

What is claimed is:

1. A silver halide photographic element comprising a silver halide emulsion which is greater than 50- mole% silver chloride, said emulsion containing an isothiazolone compound represented by the formula

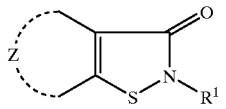

wherein $R^1$ is a substituent; and Z contains the carbon atoms necessary to form a substituted or unsubstituted five or six-membered non-aromatic ring, wherein the isothiazolone compound was added before or during precipitation of the emulsion.

2. The silver halide photographic element of claim 1 wherein wherein Z contains the carbon atoms necessary to form a substituted or unsubstituted five-membered non-aromatic ring.

3. The silver halide photographic element of claim 1 wherein $R^1$ is a hydrogen atom or a substituted or unsubstituted aliphatic aromatic or heterocyclic group.

4. The silver halide photographic element of claim 2 wherein $R^1$ is a hydrogen atom or a substituted or unsubstituted aliphatic aromatic or heterocyclic group.

5. The silver halide photographic element of claim 1 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

6. The silver halide photographic element of claim 1 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

7. The silver halide photographic element of claim 2 wherein $R^1$ is a hydrogen atom or a substituted or unsubstituted alkyl group having 1 to 6 carbon atoms.

8. The silver halide photographic element of claim 1 wherein the silver halide emulsion is greater than 90 mole-% silver chloride.

9. The silver halide photographic element of claim 1 wherein the silver halide emulsion is greater than 95 mole-% silver chloride.

10. A method of preparing a silver halide emulsion comprising precipitating a silver halide emulsion which is greater than 50 mole-% silver halide and adding to the emulsion before or during precipitation an isothiazolone compound represented by the formula

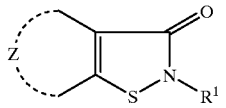

wherein $R^1$ is a substituent; and Z contains the carbon atoms necessary to form a substituted or unsubstituted five or six membered non-aromatic ring.

11. The method of claim 11, wherein wherein Z contains the carbon atoms necessary to form a substituted or unsubstituted five-membered non-aromatic ring.

12. The method of claim 10 wherein $R^1$ is a hydrogen atom or a substituted or unsubstituted aliphatic aromatic or heterocyclic group.

13. The method of claim 10 wherein $R^1$ is a hydrogen atom or a substituted or unsubstituted aliphatic aromatic or heterocyclic group.

14. The method of claim 10 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

15. The method of claim 10 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

16. The method of claim 11 wherein $R^1$ is a hydrogen atom or a substituted or unsubstituted alkyl group having 1 to 6 carbon atoms.

17. The method of claim 10 wherein the silver halide emulsion is greater than 90 mole-% silver chloride.

18. The method of claim 10 wherein the silver halide emulsion is greater than 95 mole-% silver chloride.

19. The method of claim 10 wherein the isothiazolone compound is added after initial nucleation of the silver halide emulsion.

* * * * *